US006347725B1

(12) United States Patent
Yoakim et al.

(10) Patent No.: US 6,347,725 B1
(45) Date of Patent: Feb. 19, 2002

(54) CLOSED FLEXIBLE SACHET

(75) Inventors: Alfred Yoakim, La Tour-de-Peilz; Alain Mariller, Yvonand, both of (CH)

(73) Assignee: Nestec S.A., Vevy (CH)

( * ) Notice: Subject to any disclaimer, the term of this patent is extended or adjusted under 35 U.S.C. 154(b) by 0 days.

(21) Appl. No.: 09/482,274

(22) Filed: Jan. 13, 2000

Related U.S. Application Data

(63) Continuation-in-part of application No. PCT/EP98/03826, filed on Jun. 23, 1998.

(51) Int. Cl.[7] ..... B67D 5/00

(52) U.S. Cl. ..... 222/82; 222/92; 222/94; 222/107; 222/145.1

(58) Field of Search ..... 222/81, 82, 83, 222/92, 94, 107, 145.1

(56) References Cited

U.S. PATENT DOCUMENTS

| | | | | |
|---|---|---|---|---|
| 3,224,640 A | * | 12/1965 | Schneider et al. | 222/94 |
| 3,388,836 A | * | 6/1968 | Otto et al. | 222/107 |
| 3,508,878 A | * | 4/1970 | Gunders | 222/107 |
| 3,913,789 A | * | 10/1975 | Millier | 222/107 |
| 4,220,259 A | | 9/1980 | Lagneax | 222/82 |
| 4,650,452 A | * | 3/1987 | Jensen | 222/107 |
| 4,759,472 A | * | 7/1988 | Strenger | 222/92 |
| 4,890,744 A | * | 1/1990 | Lane, Jr. et al. | 222/92 |
| 5,114,033 A | * | 5/1992 | Golias et al. | 222/82 |

FOREIGN PATENT DOCUMENTS

| | | |
|---|---|---|
| EP | 512 470 | 11/1992 |
| FR | 2 228 374 | 11/1974 |
| GB | 2 215 189 | 9/1989 |
| WO | WO 94/01344 | 1/1994 |

* cited by examiner

*Primary Examiner*—Joseph A. Kaufman
(74) *Attorney, Agent, or Firm*—Winston & Strawn

(57) ABSTRACT

The invention is directed to a closed flexible sachet in the form of an individual portion provided for extraction under pressure, containing ground roast coffee, which sachet includes two identical flexible sheets or a single folded flexible sheet of circular, oval or polygonal shape. A space for a powdered beverage is created between the two sheets or between the two faces of the folded sheet. The two sheets or the two faces of the folded sheet are welded over their periphery so that the sachet is substantially symmetrical with respect to its welding plane. The sachet is opened through the rise in pressure which takes place upon injection of an extraction fluid, in which the two flexible sheets or the two faces of the folded sheet extend over one side of the sachet beyond their welding line to provide, between the sheets or between the two faces of the folded sheet, a channel which allows the arrival of the extraction fluid. The channel is substantially perpendicular to the welding line from which it emerges.

24 Claims, 5 Drawing Sheets

CLOSED FLEXIBLE SACHET

CROSS REFERENCE TO RELATED APPLICATIONS

This application is a continuation-in-part of PCT/EP98/03826 filed Jun. 23, 1998, the content of which is expressly incorporated herein by reference.

TECHNICAL FIELD

The invention relates to a closed flexible sachet in the form of an individual portion provided for extraction under pressure, containing at least one powdered substance for the preparation of a beverage chosen from ground roast coffee, tea, instant coffee, a mixture of instant coffee and ground coffee, a chocolate-type product or any other dehydrated edible substance, consisting of two identical flexible sheets or of a single folded flexible sheet of circular, oval or polygonal shape, creating a space for the powdered substance between the two sheets or between the two faces of the folded sheet, and the two sheets or the two faces of the folded sheet are welded over their periphery so that the sachet is substantially symmetrical with respect to its welding plane, the material used for the flexible sheets is impermeable to oxygen and to water vapor in order to preserve it, and the sachet is opened through the effect only of the rise in pressure which takes place upon injection of the extraction fluid.

BACKGROUND OF THE INVENTION

Patent WO 94/01344 already relates to a closed flexible sachet provided for extraction under pressure. With this sachet, at the time of extraction, one of the flexible sheets is perforated so as to allow the arrival of the extraction water. The drawback of perforating the sheet is that firstly it is necessary to guarantee the seal over the entire periphery of the sachet and, secondly, if the coffee in the sachet is not compacted, it is not always guaranteed that the sachet will be perforated.

SUMMARY OF THE INVENTION

The present invention solves these problems by providing a closed sachet for extraction under pressure, in which it is unnecessary to guarantee the seal over the entire periphery of the sachet at the time of extraction and which makes it possible to avoid perforating one of the two flexible sheets.

The present invention thus relates to a closed flexible sachet in the form of an individual portion provided for extraction under pressure and in which the two flexible sheets or the two faces of the folded sheet extend over one side of the sachet beyond their welding line so as to provide, between the sheets or between the two faces of the folded sheet, a channel which allows the arrival of the extraction fluid, the channel being substantially perpendicular to the welding line on which it emerges.

The presence of the channel between the two flexible sheets or between the two faces of the folded sheet makes it possible to insert therein a needle or any other sharp element allowing the extraction water to be supplied without perforating or tearing one of the flexible sheets. It is unnecessary for the needle or the sharp element to enter into the channel: it is also possible to envisage the arrival of the extraction water precisely at the entry of the channel.

In one or other alternative, the sachet is not opened by inserting the needle or the sharp element to the extent of breaking the weld which closes the sachet, but it is the pressurized water which initiates and completely opens the weld of the sachet in order to allow the extraction liquid to enter. The water pressure is normally between 1 and 7 bar, i. e., in order to break the weld, a minimum pressure of water is required to open the weld.

BRIEF DESCRIPTION OF THE DRAWINGS

The preferred features of the invention can be ascertained from the following detailed description and drawing figures, wherein.

DETAILED DESCRIPTION OF THE INVENTION

Figure 1:
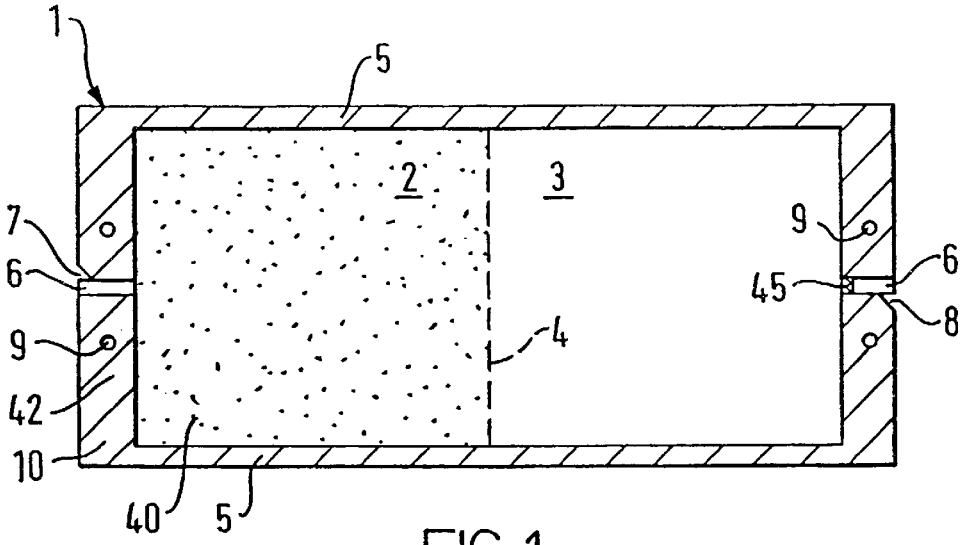
FIG. 1 is a plan view of a blank for manufacturing a sachet according to the invention.

The method and the device which arc used for the extraction of sachets according to the invention may advantageously be of the type which partially forms the subject of EP Patent Application Nos. 92107548 and 92112364. "Partially" is understood to mean that the device is used not for the arrival of the water but for the exit of the coffee. The lower face of the sachet is opened by localized ruptures after its deformation against the non-perforating and non-cutting raised and hollowed-out elements present on the lower face of the device through the effect only of the rise in pressure which takes place upon injection of the extraction fluid.

The sachet according to the invention may be of square, rectangular, oval or other shapes. If the sachet is of rectangular shape, it has a width from about 2 cm to about 15 cm, preferably from about 4 cm to about 6 cm, and a length from about 5 cm to about 30 cm, preferably from about 6 cm to about 20 cm. Depending on the size of the sachet, it is possible to envisage the extraction of a single cup or of several cups, for example of two cups. Once filled, the sachet has a thickness, at its center from about 3 mm to about 30 mm, preferably from about 5 mm to about 20 mm. The measured amount of powdered substance contained may vary from about 1 g to about 75 g, preferably from about 5 g to about 50 g, according to its use. The coffee is normally in the sachet in non-compacted form, which makes the sachet relatively soft. It is, however, also possible to package compacted coffee. The depth of the arrival channel for the extraction fluid is normally from about 1 mm to about 15 mm, preferably from about 3 mm to about 10 mm and the diameter of this channel is from about 1 mm to about 15 mm, preferably from about 3 mm to about 10 mm. The weld which closes the sachet normally has a depth from about 1 mm to about 3 mm.

In order to accommodate the coffee on the flexible sheets or the folded flexible sheet, the sheets are molded either by means of compression in a die/piston assembly, or by means of pressurization of the inner faces by a gas and/or suction of the outer faces. In both cases, the mold has the desired relief.

The sheets or the folded sheet may be made from flexible material such as aluminum with a thickness of from 5 microns to 40 microns or from plastic such as polyester (PET).

Preferably, the sheets will consist of a flexible, multi-layer material which is suitable for welding using customary methods while at the same time forming sufficient protection for the product against oxygen and water vapor. The following combination of materials are preferred:

- outer layer: PET (normal, woven or non-woven), polyethylene (PE), polypropylene (PP), polyamide (PA), polystyrene (PS) or paper having a thickness from about 1 micron to about 20 microns and preferably from about 5 microns to about 15 microns;
- high-grade barrier central layer; aluminum, a copolymer of ethylene and vinyl alcohol (EVOH), polyvinylidene (PVDC), PET or polyvinylacetate (PVA) having a thickness from about 3 microns to about 25 microns and preferably from about 5 microns to about 20 microns;
- inner layer: plastic, preferably PE or PP or oriented polypropylene (OPP) with welding lacquer and having a thickness from about 1 microns to about 20 microns, and preferably from about 5 microns to about 15 microns. The total thickness of these layers is generally from 5 microns to 40 microns.

A seal is normally achieved at a temperature of between 180° C. and 250° C.

It is possible to envisage the following multi-layer combinations: PET-EVOH-PE or PET-aluminum-PE. The use of biodegradable or water-soluble material is also possible as a single layer or in combination with other material.

The sachet according to the invention is manufactured in the conventional manner by means of deformation by molding or by drawing of the two flexible sheets or of the folded flexible sheet which are impermeable to oxygen and to water vapor, by measuring the amount of powdered substance onto one of the flexible sheets and by welding the two sheets or the two faces of the folded sheet over their periphery. The manufacturing operations are carried out under the protection of a stream of oxygen-free inert gas, such as, argon, nitrogen or $CO_2$.

The major advantage of the sachet according to the invention is that it allows the arrival of the extraction water via a small opening in the weld between the two flexible sheets or between the two faces of the folded sheet. In this embodiment, it is possible to envisage several solutions. The channel between the two flexible sheets or between the two faces of the folded sheet may, emerge directly on the welding line and the extraction fluid then has a single path via which to arrive at the sachet. By contrast, if it is desired to improve the distribution of the flow into the bed of coffee, a subdivided arrival channel can be used, after the welding line of the two flexible sheets or of the two faces of the folded sheet, into at least two channels emerging at different points in the sachet: for example, in the case of a sachet for a single cup, two arrival channels are envisaged, and, in the case of a sachet for two cups, four arrival channels are envisaged.

In the sachet-extraction device, it is a sharp element which is engaged into the water-arrival channel. So as to guarantee satisfactory insertion of the sharp element into the channel, provision is made on each flexible sheet or on each face of the folded sheet for a break at the location of the channel, allowing separation of the flexible sheets or of the faces of the folded sheet at the moment the extraction device is pierced. In another embodiment, it is also possible to envisage offsetting the two faces of the folded sheet at the location of the channel. As already mentioned above, it is not obligatory for the sharp element to engage in the channel.

According to another embodiment of the invention, a tube, which is either adhesively bonded, or crimped or laid in position is placed in the extension of the channel. The advantage of this tube is that it facilitates the insertion of the sharp element.

At the moment of extraction of the sachet according to the invention, it is held in the extraction cavity and this guarantees satisfactory performance of the weld of the two flexible sheets. This performance is not guaranteed only at the location of the arrival channel for the extraction fluid, so that the pressure of the fluid breaks the weld at this point, and only at this point, so as to allow the extraction water to enter into the sachet through this channel or the channels.

As mentioned above, the sachet according to the invention needs a satisfactory seal vis à vis the extraction fluid only at the location of the arrival channel. Consequently, it facilitates, the design of the extraction machine and therefore the latter's cost.

FIG. 1 illustrates the blank (1) which is a multi-layer flexible sheet based on aluminum, polyethylene and polypropylene, having a thickness of the order of 40 microns and which is foldable along the line (4). This sheet is thermoformed so as to create in it two cavities (2, 3) which make it possible to receive the ground roast coffee (40) therein. The flexible sheet is then folded along the line (4) and the two faces of the sheet are welded along the hatched lines (5, 42). This welding provides a channel (6) between the two faces, allowing the insertion of the sharp element for sachet extraction.

FIG. 1 has a channel (6) emerging directly onto the bed of coffee. At the moment of use of the sachet, the water arrives via the channel and the pressure of this water breaks the seal (45). To facilitate the insertion of the sharp element, provision is made for breaks (7, 8) on the two faces of the flexible sheet (1), which makes it possible, when the edge is pinched in the extraction device, satisfactorily to open up the opening of the channel (6). In the case of the figure, there is a sachet, for two cups, which has a width of 4.5 cm and a length of 9 cm in the case of each cavity (2, 3). The border (10) of the sachet which goes beyond the weld (42) has a width of from 2 to 4 cm.

Figure 2:
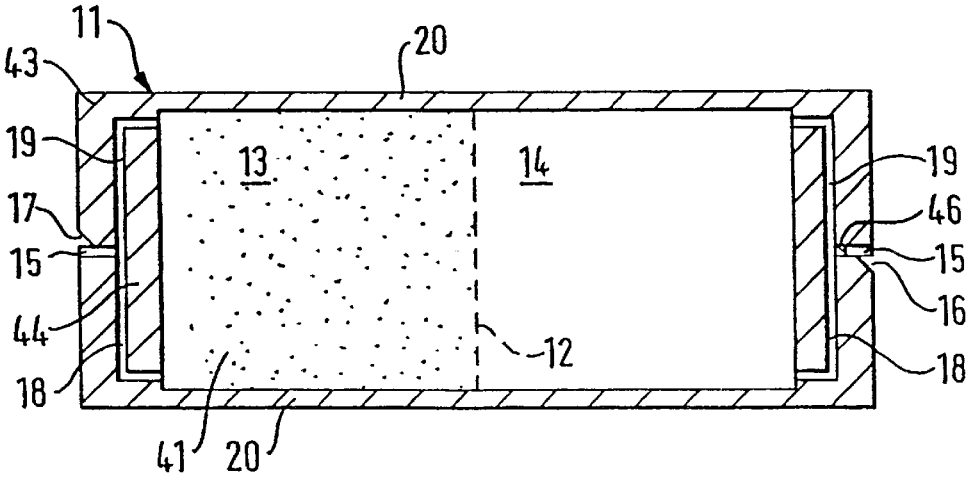
FIG. 2 is a plan view of a second embodiment of a blank.

FIG. 2 illustrates a sheet (11) based on the same composite as for FIG. 1, the sheet being foldable along the line (12). It includes cavities (13, 14) for the ground roast coffee (41). The sheet is then folded over and welded along the hatched zones (20, 44) and a channel (15) is made in it which is subdivided into two channels (18, 19), allowing the water for extraction to arrive at two different points in the bed of coffee. When the water arrives, it breaks the weld in the zone (46) and allows sachet extraction. The breaks (16, 17) permit satisfactory opening of the channel (15) at the moment of extraction. The border (43) which goes beyond the weld (44) has a width of from 2 to 4 cm.

Figure 3:
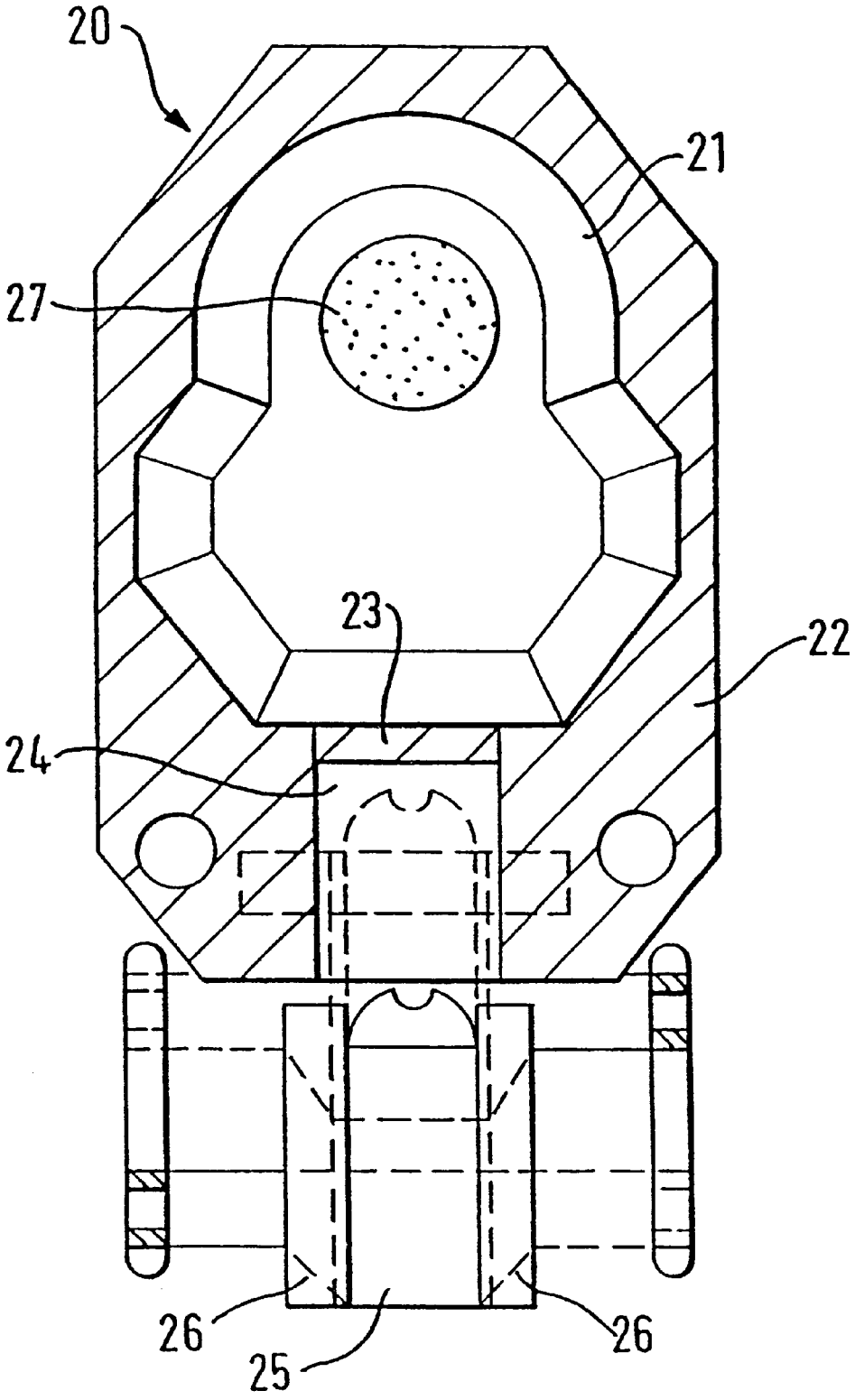
FIG. 3 is a diagrammatic plan view of the sachet during extraction.

FIG. 3 shows a sachet (20) of more oval shape, with its measured amount of coffee (21). The weld also appears in the form of hatched zones (22). The welding zone (23) forms the separation between the channel (24) and the bed of coffee (21). The sharp element (25) is displaced between its guides (26) from a set-back position to a position of engagement in the channel (24). It is from this moment onwards that the extraction fluid arrives at a pressure of between 1 and 3 bar and breaks the weld (23). The pressure in the sachet increases and the lower face of the sachet presses against raised and hollowed-out elements which are diagrammatically represented at (27), until the face tears at the locations of the raised and hollowed-out elements so as to allow the coffee to flow into the cup placed beneath the extraction device.

Figure 4:
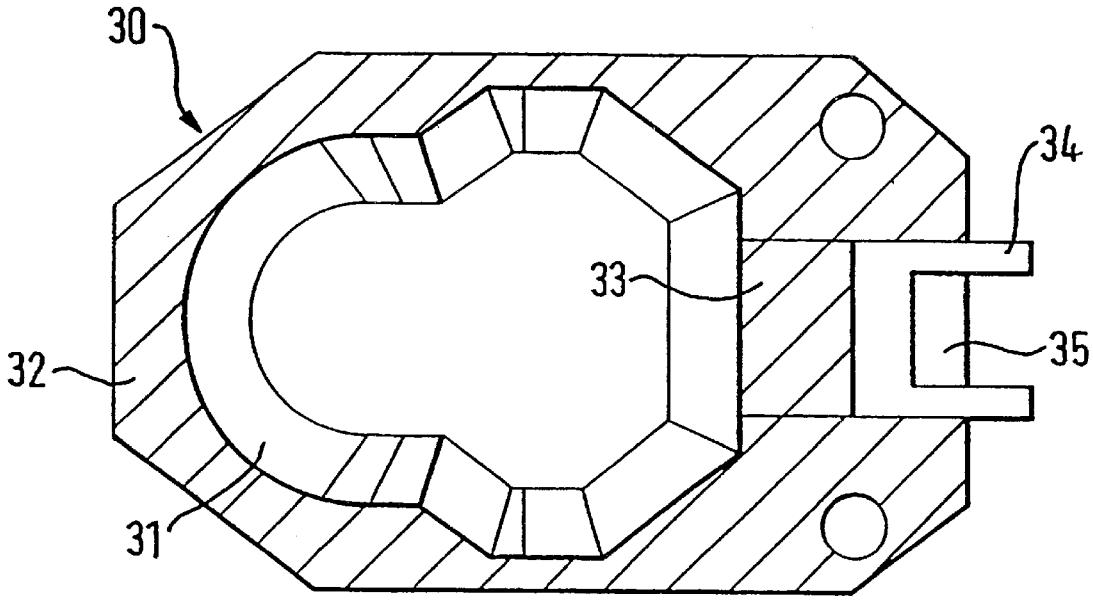
FIG. 4 is a plan view of a third embodiment of the sachet.

FIG. 4 shows a sachet (30) which has a measured amount of coffee (31) with a weld (32), the weld (33) forming the separation between the measured amount of coffee and the channel (31) for the arrival of the extraction fluid. In this channel, provision is made for a tube (34), allowing satisfactory insertion of the sharp element.

Figure 5:
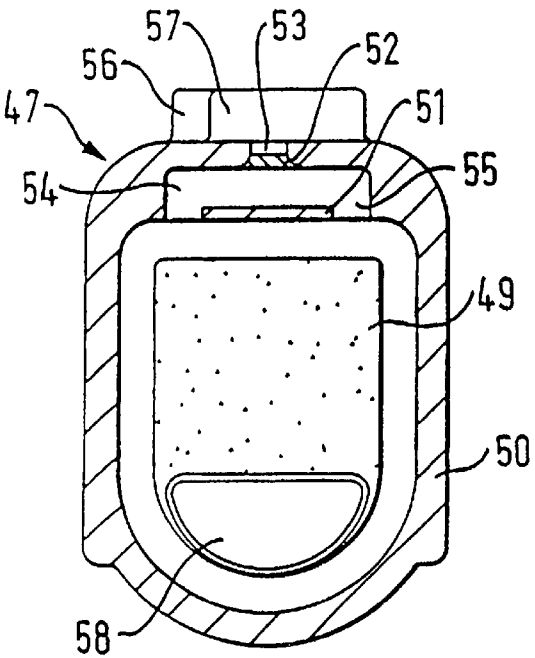
FIG. 5 is a plan view of a fourth embodiment of the sachet.

FIG. 5 shows a sachet (47) obtained from a folded-over sheet, which gives two faces (56, 57). This sachet is provided for a single cup of coffee with one measured amount of coffee (49). The weld appears in the form of hatched zones (50, 51). The welding zone (52) forms the separation between the channel (53) and the bed of coffee (49). After the weld (52), the channel (53) is subdivided into two channels (54, 55), so that the water satisfactorily moistens the coffee at two different locations. At the moment of extraction of the sachet (47), the offset of the two sheets (56, 57) allows satisfactory opening-up of the channel (53) to permit satisfactory positioning of the water-arrival channel on the channel (53). The extraction fluid arrives at a pressure of between 1 and 4 bar and breaks the weld (52). The water then flows into the sachet and the pressure in the sachet increases, and the lower face of the sachet presses against raised and hollowed-out elements represented diagrammatically at (58) until the face tears at the locations of the raised and hollowed-out elements so as to allow the coffee to flow into the cup placed beneath the extraction device.

Figure 6:
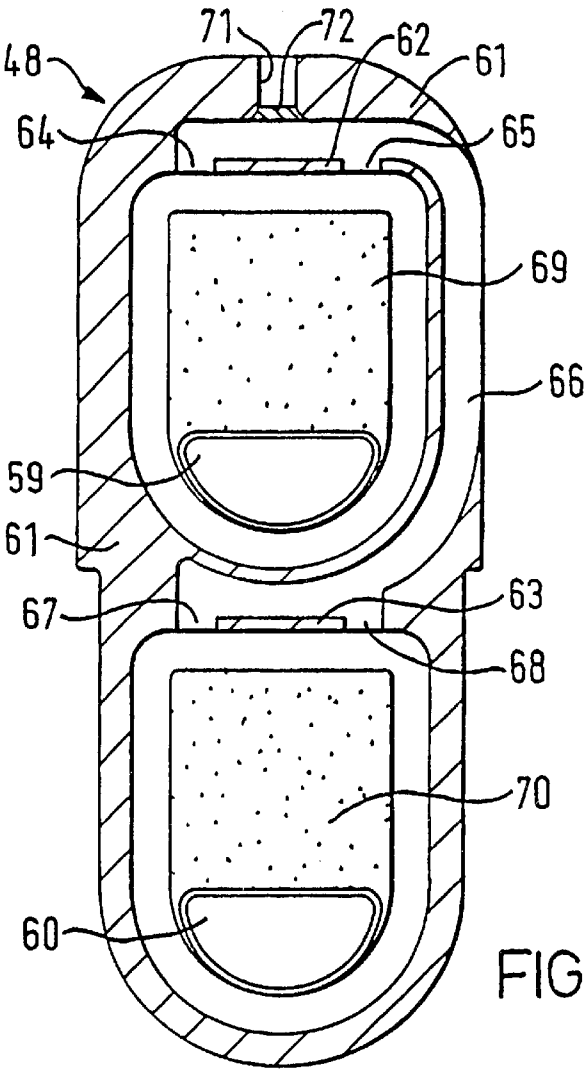
FIG. 6 is a plan view of a fifth embodiment of the sachet.

FIG. 6 shows a sachet (48) which makes it possible to prepare two cups of coffee with a measured amount of coffee (69) and a measured amount (70). The weld appears in the form of hatched zones (61, 62, 63). The welding zone (72) forms the separation between the channel (71) and the bed of coffee (69). After the weld (72), the channel (71) is subdivided into three channels: the two channels (64, 65) firstly allowing the extraction water to progress onto the bed of coffee (69) and, secondly, a third channel (66) allowing the water to progress towards the second bed of coffee (70). This channel (66) is then itself subdivided into two channels (67, 68). At the moment the sachet is used, the extraction fluid arrives via the channel (71) at a pressure of between 1 and 4 bar and breaks the weld (72). The pressure in the sachet increases and the lower face of the sachet presses against the raised and hollowed-out elements represented diagrammatically at (59, 60) until the face tears at the locations of the raised and hollowed-out elements so as to allow the coffee to flow into the two cups placed beneath the extraction device.

Figure 7:
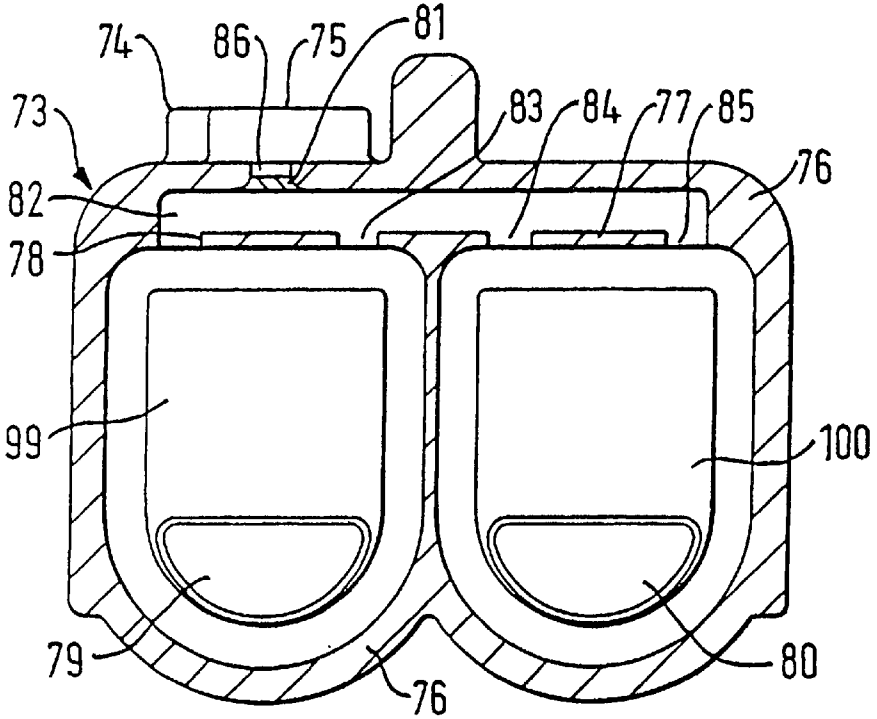
FIG. 7 is a plan view of a sixth embodiment of the sachet.

FIG. 7 shows a sachet (73) obtained from a folded-over sheet giving two faces (74, 75). This sachet is provided for two cups of coffee with measured amounts of coffee (99, 100). The weld appears in the form of hatched zones (76, 77, 78). The welding zone (81) forms the separation between the channel (86) and the beds of coffee (99, 100). After the weld (81), the channel (86) subdivides into four channels: two channels (82, 83) for the bed of coffee (99) and two channels (84, 85) for the bed of coffee (100). At the moment of extraction of the sachet (73), the offset of the two sheets (74, 75) allows satisfactory opening-up of the channel (86) to allow satisfactory positioning of the water-arrival channel on the channel (86). The extraction fluid arrives at a pressure of between 1 and 4 bar and breaks the weld (81). The water then flows into the sachet and the pressure in the sachet increases and the lower face of the sachet presses against the raised and hollowed-out elements represented diagrammatically at (79, 80) until the face tears at the locations of the raised and hollowed-out elements so as to allow the coffee to flow into the two cups placed beneath the extraction device.

Figure 8:
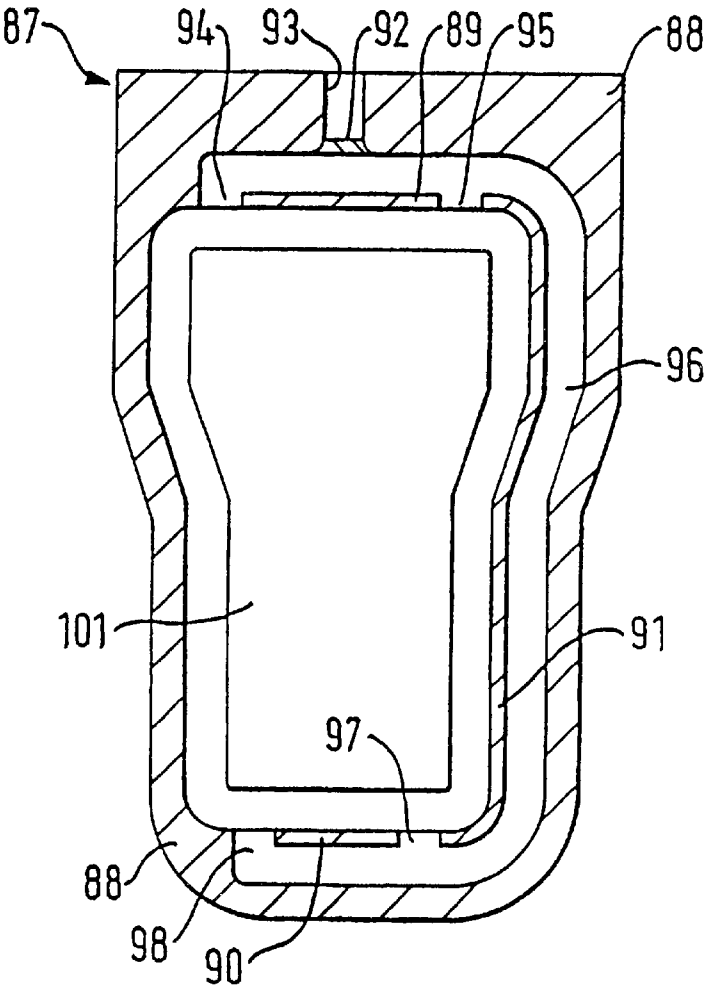
FIG. 8 is a plan view of a seventh embodiment of the sachet.

FIG. 8 shows a sachet (87) which makes it possible to prepare two cups of coffee with one measured amount of coffee (101). The weld appears in the form of hatched zones (88, 89, 90, 91). The welding zone (92) forms the separation between the channel (93) and the bed of coffee (101). After the weld (92), the channel (93) subdivides into three channels: the first two (94, 95) lead directly to the bed of coffee (101), and the third (96) conveys the water towards the bottom of the sachet. At the bottom of the sachet, it subdivides again into two channels (97, 98). In this embodiment, the water arrives at four points on the bed of coffee, which allows satisfactory moistening of the coffee and satisfactory extraction from the sachet.

It is well understood that the sachet according to the invention may be manufactured either from two flexible sheets or from a single folded flexible sheet. The advantage of this second solution is that it dispenses with one welding zone and thus reduces the risks of a defective seal in the sachet according to the invention.

What is claimed is:

1. A closed flexible sachet which contains an individual portion of a powdered beverage for extraction under pressure, comprising:

at least one flexible sheet welded along a welding line around its periphery to form an interior space for containing the powdered beverage, the sachet being substantially symmetrical with respect to its welding plane; and a channel for water ingress and having an outside portion formed by an edge of the sheet that extends beyond the welding line opposite from the interior space, the channel being oriented substantially perpendicular to the welding line;

wherein the flexible sheet is impermeable to oxygen and to water vapor, and the welding line is sufficiently weak across the channel for breaking upon injection of an extraction fluid at a sufficient pressure in the outside channel portion for opening the channel and permitting ingress of the extraction fluid through the channel into the interior space.

2. The closed flexible sachet according to claim 1, wherein the sheet is made of aluminum, polyester, polyethylene, polypropylene, polyamide, polystyrene, paper, copolymer of ethylene and vinyl alcohol, polyvinylidene chloride, polyvinylacetate or mixtures thereof.

3. The closed flexible sachet according to claim 1, wherein a single flexible sheet is provided and is folded upon itself to form the interior space.

4. The closed flexible sachet according to claim 1, wherein a plurality of flexible sheets are present.

5. The closed flexible sachet according to claim 1, wherein the channel divides into at least two channels within the sachet after the welding line in order to enter the interior space at different points.

6. The closed flexible sachet according to claim 1, wherein the channel comprises a tube adhesively bonded, crimped, or laid in position.

7. The closed flexible sachet according to claim 1, wherein the depth of the channel is from about 1 mm to about 15 mm and the width is from about 1 mm to about 15 mm.

8. The closed flexible sachet according to claim 1, wherein the depth of the channel is from about 3 to about 10 mm and the width is from about 3 to about 10 mm.

9. The closed flexible sachet according to claim 1, wherein the welding line opens at one side upon injection of a pressurized fluid into the interior space.

10. The closed flexible sachet according to claim 9, wherein the pressure is from 1 bar to about 7 bar.

11. The closed flexible sachet according to claim 1, wherein the space comprises at least two compartments.

12. The closed flexible sachet according to claim 1, wherein the powdered beverage is selected from the group consisting of ground roast coffee, tea, instant coffee, a mixture of instant coffee and ground coffee, a chocolate product, dehydrated milk, and dehydrated cream.

13. The closed flexible sachet according to claim 11, wherein the powdered beverage is present in an amount from about 5 g to about 50 g.

14. The closed flexible sachet according to claim 1, wherein the sachet has a circular, oval, rectangular or polygonal shape.

15. The closed flexible sachet according to claim 13, wherein the sachet has a rectangular shape with a width of about 2 cm to about 15 cm and a length from about 6 cm to about 20 cm.

16. The closed flexible sachet according to claim 1, wherein the channel is disposed on an opposite side of the welding line from the interior space.

17. A closed flexible sachet, comprising:

a beverage component;

at least one flexible sheet sealed along a sealing line around its periphery to define an interior space containing the beverage component, the sheet comprising overlapping edges; and a channel configured and dimensioned for ingress of extraction fluid into the interior space, the channel having an outside channel portion defined between the overlapping edges and extending towards the sealing line on an opposite side from the interior space;

wherein the flexible sheet is impermeable to oxygen and to water vapor; and wherein the sealing line is sufficiently weak across the channel for breaking upon injection of the extraction fluid at a sufficient pressure in the outside channel portion for opening the channel and permitting ingress of the fluid through the channel into the interior space.

18. The sachet of claim 17, wherein the beverage component comprises a powdered beverage, and the extraction fluid component comprises water.

19. The sachet of claim 17, wherein the sachet is substantially symmetrical about the sealing line.

20. The sachet of claim 17, wherein the channel is oriented substantially perpendicular to the sealing line.

21. The sachet of claim 17, wherein the channel comprises a first portion and a plurality of second portions, wherein the second portions are fluidly communicated with the first portion and extend toward the sealing line towards the inner space.

22. The sachet of claim 17, wherein the channel comprises a tube attached to the sheet.

23. The sachet of claim 17, wherein the first beverage component comprises at least one of the group consisting of ground roast coffee, tea, instant coffee, a mixture of instant coffee and ground coffee, a chocolate product, dehydrated milk, and dehydrated cream, and the second beverage component comprises water.

24. The sachet of claim 17, wherein the seal comprises a weld.

* * * * *

UNITED STATES PATENT AND TRADEMARK OFFICE

CERTIFICATE OF CORRECTION

PATENT NO. : 6,347,725 B1
DATED : February 19, 2002
INVENTOR(S) : Yoakim et al.

It is certified that error appears in the above-identified patent and that said Letters Patent is hereby corrected as shown below:

Title page,
Item [62], Related U.S. Application Data, please insert the following section:
-- [30] Foreign Application Priority Data
Jul. 15, 1997 (EP) …… 97202190 --.

Signed and Sealed this

Third Day of December, 2002

JAMES E. ROGAN
*Director of the United States Patent and Trademark Office*